United States Patent [19]

Tang

[11] 4,167,073

[45] Sep. 11, 1979

[54] POINT-OF-SALE DISPLAY MARKER ASSEMBLY

[75] Inventor: Darl L. Tang, Elmhurst, Ill.

[73] Assignee: Dynasty Design, Inc., Elmhurst, Ill.

[21] Appl. No.: 815,545

[22] Filed: Jul. 14, 1977

[51] Int. Cl.[2] ..... G09F 1/00

[52] U.S. Cl. ..... 40/124.1; 40/584

[58] Field of Search ..... 40/124.1, 125 H, 16, 40/11 R, 125 R, 10 R, 617, 613, 584; 46/157

[56] References Cited

U.S. PATENT DOCUMENTS

| | | | |
|---|---|---|---|
| 1,415,782 | 5/1922 | Brace | 40/10 R X |
| 2,141,342 | 12/1938 | Brownell | 40/11 R |
| 2,828,565 | 4/1958 | Goldstein | 40/125 R X |
| 3,423,860 | 1/1969 | Berry et al. | 40/125 R X |
| 3,706,150 | 12/1972 | Greenberger | 40/124.1 |
| 3,774,328 | 11/1973 | Tanney | 40/10 R |
| 4,054,001 | 10/1977 | De Pinna | 40/124.1 |

*Primary Examiner*—Louis G. Mancene
*Assistant Examiner*—Wenceslao J. Contreras
*Attorney, Agent, or Firm*—Kinzer, Plyer, Dorn & McEachran

[57] ABSTRACT

A point-of-sale display marker assembly including a paper base member with slits cut therein and mountable on a commodity shelf, an attention-catching display marker of paper also with slits cut therein, and an elongated, flat, transparent, resilient support member with tabs at each end which are insertable into the slits in the base member and the display marker to form a unitary assembly having the display marker suspended in space in front of the commodity shelf.

4 Claims, 10 Drawing Figures

Fig. 2.
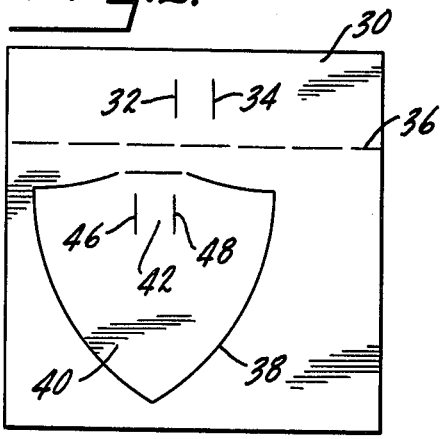
Fig. 3.
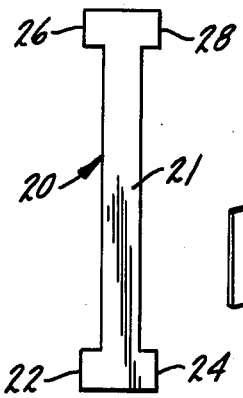
Fig. 4.
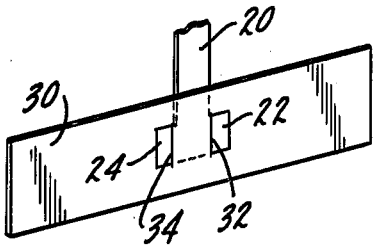
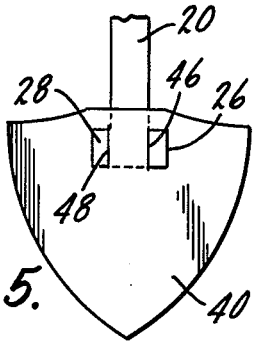
Fig. 5.
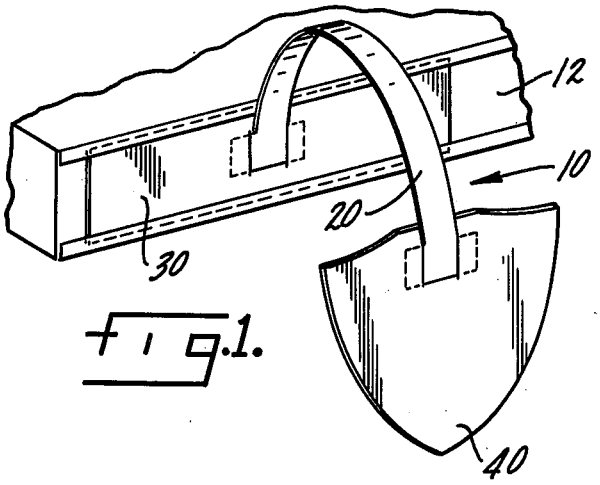
Fig. 1.
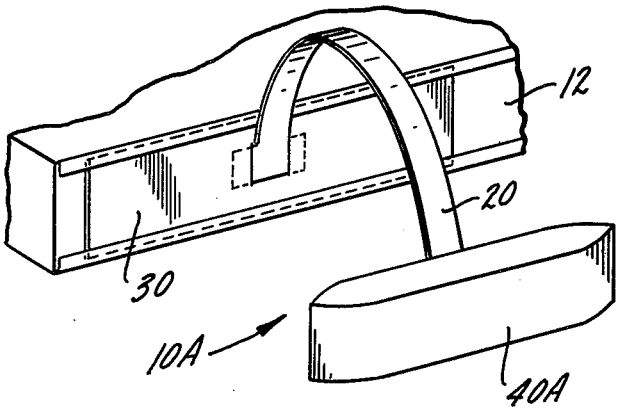
Fig. 6.
Fig. 7.
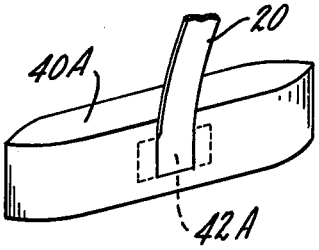

POINT-OF-SALE DISPLAY MARKER ASSEMBLY

BACKGROUND OF THE INVENTION

This invention relates to point-of-sale shelf markers and, more precisely, to three-dimensional attention-attracting markers particularly intented for use in grocery, department, and other retail stores.

While many types of three-dimensional markers are known, they often require complex configurations and supports that lead to a relatively high cost to the merchant displaying them. This is particularly true where the eye-catching device is of "mobile" construction. Berry et al U.S. Pat. No. 3,423,860 discloses a price rail marker made from a single flat sheet. The marker is to be affixed to a shelf at the bottom edge so that the weight of the marker causes it to bend forwardly into an inverted U-shape. The marker is made of resilient material so that small local air currents cause it to oscillate randomly like a "mobile".

But the Berry marker presents distinct problems, especially with respect to cost of implementation. Since the marker is affixed at the bottom and has the top portion bent over essentially 180°, both sides of the piece must be printed to obtain full space utilization. Also, since the support member has to be slender while the base and top portions of the marker are wide, the process of cutting or punching out the unitized marker from a single sheet causes a high percentage of that sheet to be wasted. Cutting a unitized marker from a single sheet also means the base and display tag portions must be made of the same material as the support member. Since the base and the display tag do not require the same resiliency as the support member, it is more economical if these parts can be made of cheaper materials such as paper. At the conclusion of the particular promotion in which the Berry marker was used the entire piece has to be removed and either discarded or stored; no part was re-usable. Further, if it is desired to display a plurality of markers from a single base, the Berry design is limited to a horizontal array, since the support member extends from the plane of the top edge of the base portion.

SUMMARY OF THE INVENTION

It is an object of the present invention to provide a three-dimensional attention-attracting point-of-sale display marker assembly which can be fabricated at minimum cost.

It is a further object of the present invention to provide a point-of-sale display marker assembly which is partially re-usable.

Still another object of this invention is to provide a point-of-sale display marker assembly that can afford horizontal, vertical, or cascaded arrays.

Accordingly, the invention is directed to a point-of-sale display marker assembly comprising a base member, a display marker and a support member. The base member has two spaced vertical slits and a flat configuration suitable for attachment to a commodity shelf. The display marker has a flat attachment element which also has two spaced vertical slits. The display marker is connected to the base and suspended spatially in front of the shelf by an elongated, thin, flat, resilient support member. Tabs at each end of the support member are insertable into the slits cut in the base and display marker attachment element. The portion of the support member near the base initially extends upwardly from the base. The weight of the display marker causes the support member to bend forwardly, away from the shelf into an inverted catenary shape.

BRIEF DESCRIPTION OF THE DRAWINGS

FIG. 1 is a perspective view of a point-of-sale display marker assembly, constructed in accordance with one embodiment of the invention;

FIG. 2 shows a base member and display marker formed from a single sheet, prior to separation from the sheet for assembly;

FIG. 3 is an elevation view of the support member before it has been connected to the base member and display maker;

FIG. 4 is a rear perspective view of the base member mounted on the support member;

FIG. 5 is a rear elevation view of the display marker mounted on the support member;

FIG. 6 is a front perspective view of a point-of-sale display marker assembly with a three-dimensional display marker;

FIG. 7 is a rear perspective view of the display marker attachment element of the three-dimensional display of FIG. 6;

DESCRIPTION OF THE PREFERRED EMBODIMENT

Figure 8:
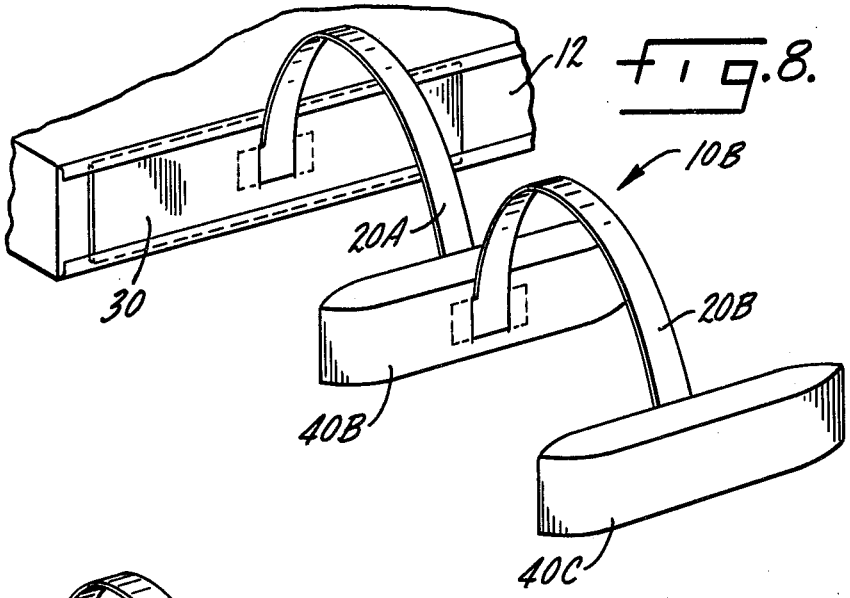
FIG. 8 is a perspective view of a cascaded array of display markers comprising a further embodiment of the invention.

A point-of-sale display marker assembly 10, constructed in accordance with one embodiment of the invention, is shown in FIG. 1 mounted on a commodity display shelf 12. The marker assembly 10 includes a support member 20 that extends upwardly from a base member 30 and is bent forwardly by the weight of a display marker 40 into an inverted catenary shape. The support member 20 is made of a resilient material, usually plastic, so that the display marker 40 will oscillate randomly as it is disturbed by small local air currents. The display marker 40 can be of any shape or can have any sort of writing on it required to attract the attention of passersby.

FIG. 2 shows how a simple base member and display marker could be formed from a single piece of sheet material. This sheet could be plastic or some other suitable lightweight material, but paper is the preferred material. The base member 30 is separated from the rest of the sheet by perforations at 36 and includes two slits 32 and 34. The display marker is similarly perforated along its outer edges at 38 and has two slits 46 and 48. Both the base member and display marker can be printed with advertising material at the same time on one side. The slits 32, 34, 46 and 48 and the perforations 36 and 38 can all be cut in a single operation.

The support member 20 is shown in FIG. 3. It has a shank 21 and base tabs 22 and 24 and marker tabs 26 and 28. The support member is preferably made of transparent material to permit full view of any writing on the base member 30.

A simple configuration of the base member 30 is shown in FIG. 4. The slits 32 and 34 in the base member are spaced apart by a distance approximately equal to the width of the shank 21 of the support member 20. The base member can be of any configuration necessary for mounting it on a display rack or shelf.

The display marker 40 is shown in FIG. 5. Its vertical slits 46,48, cut in it to form the attachment element 42, are also spaced by a distance approximately equal to the width of the support member shank 21. When a flat, one-piece display marker is used, the attachment element 42 and the display marker are formed in the same piece.

To assemble the entire retail display marker, the base member 30 is separated along perforations 36 (FIG. 2) from the display marker card. The base tabs 22 and 24 of the support member 20 are inserted into slits 32 and 34 of the base member. This is done in a manner such that the shank of the support member extends upwardly from the base (FIG. 4). The display marker 40 is separated from the balance of the card (FIG. 1) along perforations 38. The marker tabs 26 and 28 are inserted into the slits 46 and 48 as shown in FIG. 5. The weight of the display marker causes the support member to bend forwardly and away from the display shelf into an inverted catenary shape, when mounted in the position of use, as shown in FIG. 1.

A modification 10A of the point-of-sale display marker assembly is shown in FIGS. 6 and 7. In this embodiment the display marker 40A has a three-dimensional configuration. Typically, this will be a facsimile of the product being sold, such as the candy bar shown. The display marker 40A can still be formed from a single sheet of paper, initially integral with the support member 30, but with appropriate markings for fold lines and assembly to three-dimensional form. The attachment element 42A forms one side of a display marker 40A, as can be seen in FIG. 7. The base member 30 and support member 20 remain the same as in the embodiment of FIGS. 1–5.

FIG. 8 shows a cascaded array 10B of display markers. In this arrangement a first display marker 40B suspended from a base member 30 by a first support member 20A also serves as a base member for a second support member 20B. The first support member 20A in this cascaded array may be somewhat stronger to hold the added weight of the second support member 20B and a second display marker 40C. The first support member can be strengthened by increasing the width of the shank near the base tabs, If this is done the spacing of the base member slits will be correspondingly increased.

Figure 9:
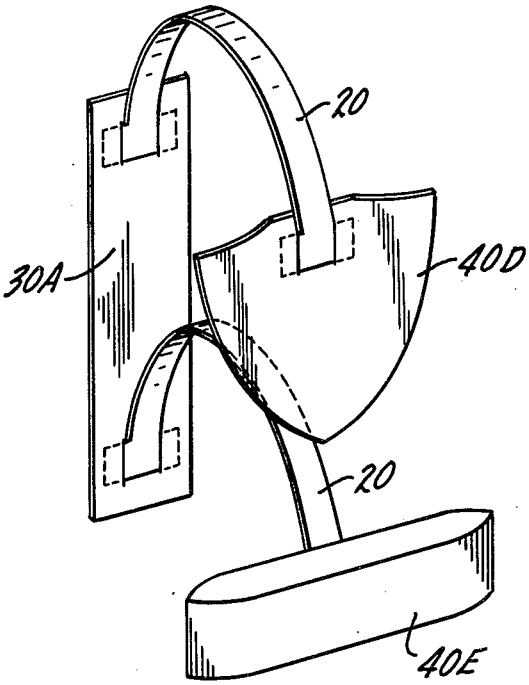
FIG. 9 is a perspective view of a vertical array of display markers according to yet another embodiment of the invention.

FIG. 9 shows how a plurality of display markers 40D, 40E can be incorporated in a vertical array with a suitable base member 30A and two support members 20. A similar arrangement can be utilized for a horizontal array.

Figure 10:
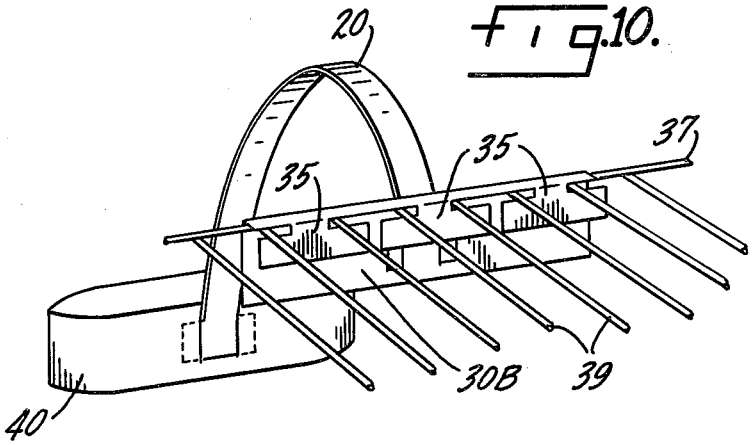
FIG. 10 is a perspective view of a base member for a display marker, having T-shaped tabs on one edge which are folded over and between the wires of a wire rack display, comprising an additional embodiment of the invention.

FIG. 10 shows a modified base member 30B which has a series of T-shaped tabs 35 along one edge suitable for folding over the edge wire 37 of a wire rack display between the rack wires 39. The tabs 35 are inserted between the wires 39 to hold the base member 30B on the rack. One or more support members 20 and display markers 40 complete the assembly. The base member and display marker or markers can still be formed from a single sheet of paper printed on only one side. It will be recognized that in any of the embodiments of the invention, directions for assembling may be printed on the margin portions of the display marker-base member sheet at the time the advertising material is printed.

I claim:

1. A point-of-sale display marker assembly comprising:

a base member comprising a thin, flat, relatively resilient sheet having a configuration suitable for attachment to a retain commodity shelf and having two spaced vertical slits cut therein;

a display marker member of three-dimensional configuration, one side of the display marker member comprising a thin, flat attachment element having two spaced vertical slits cut therein;

and an elongated thin, flat, resilient support member having tabs at each end insertable into the slots of the base member and the one side of the display marker member respectively to interconnect the three individual members in a unitary marker assembly, the weight of the display marker member causing the resilient support member to bend forwardly away from the commodity shelf into an inverted catenary shape.

2. A point-of-sale display marker assembly comprising:

a base member comprising a thin, flat, relatively resilient sheet having a configuration suitable for attachment to a retail commodity shelf and having two spaced vertical slits cut therein;

first and second elongated, thin, flat, resilient support members, each support member having tabs at each end;

a first display marker member comprising a thin, flat attachment element having two spaced vertical slits cut therein and further comprising a thin, flat base element having two spaced vertical slits cut therein;

and a second display marker member comprising a flat attachment element having two spaced vertical slits cut therein;

at least one of the display marker members having a three-dimensional configuration with its attachment element comprising one side of the display marker member;

the tabs of the second support member being inserted in the slits of the second display marker member and the base element of the first display marker member respectively, the weight of the second display marker member causing the second resilient support member to bend forwardly away from the first display marker member into an inverted catenary shape, the tabs of the first support member being inserted in the slits of the attachment element of the first display marker member and the base member respectively, the weight of the second display marker member, second support member and first display marker member causing the first resilient support member to bend forwardly away from the commodity shelf into an inverted catenary shape.

3. A point-of-sale display marker assembly comprising:

a base member comprising a thin, flat, relatively resilient sheet having a configuration suitable for attachment to a retail commodity shelf and having two spaced vertical slits cut therein;

the base member having T-shaped tabs along one edge suitable for folding over the edge of a wire rack display, the T-shaped tab being inserted between the wires of the rack to hold the base member in position;

a display marker member comprising a flat attachment element having two spaced vertical slits cut therein;

and an elongated thin, flat, resilient support member having tabs at each end insertable into the slots of the base member and the display marker member respectively to form a unitary marker assembly, the weight of the display marker member causing the resilient support member to bend forwardly away from the commodity shelf into an inverted catenary shape.

4. A point-of-sale display marker assembly according to claim 3 wherein the display marker member has a three-dimensional configuration, and the attachment element comprises one side of the display marker member.

* * * * *